US006893158B1

(12) United States Patent
Tipp et al.

(10) Patent No.: US 6,893,158 B1
(45) Date of Patent: May 17, 2005

(54) LINER RETAINER DEVICE

(76) Inventors: Raymond P. Tipp, P.O. Box 3778, Missoula, MT (US) 59806; Ronald F. Tipp, P.O. Box 3778, Missoula, MT (US) 59806

( * ) Notice: Subject to any disclaimer, the term of this patent is extended or adjusted under 35 U.S.C. 154(b) by 20 days.

(21) Appl. No.: 10/461,728

(22) Filed: Jun. 13, 2003

Related U.S. Application Data

(63) Continuation-in-part of application No. 29/169,748, filed on Oct. 28, 2002, now Pat. No. Des. 489,154.

(51) Int. Cl.[7] ..... B65D 33/16

(52) U.S. Cl. ..... 383/71; 383/62; 156/270; 248/99

(58) Field of Search ..... 220/495.08, 908.1, 220/908, 495.06, 495.11; 29/482, 481, 304; 602/41, 42; 383/33, 42, 78, 71, 62; 248/99; 156/270, 269, 229, 160

(56) References Cited

U.S. PATENT DOCUMENTS

| | | | | |
|---|---|---|---|---|
| 3,148,799 | A | 9/1964 | Meroney | |
| 3,443,971 | A * | 5/1969 | Wood | 426/124 |
| 3,927,445 | A | 12/1975 | Pavlish | |
| 4,027,774 | A | 6/1977 | Cote | |
| 4,328,895 | A * | 5/1982 | Jaeger | 206/496 |
| 4,335,769 | A | 6/1982 | McManus | |
| 4,611,350 | A | 9/1986 | Kaczerwaski | |
| 4,822,178 | A * | 4/1989 | Taylor | 383/33 |
| 4,948,266 | A | 8/1990 | Bencic | |
| 5,044,772 | A | 9/1991 | Larson | |
| 5,120,138 | A | 6/1992 | Midgley et al. | |
| 5,133,607 | A | 7/1992 | Bonke | |
| 5,181,628 | A | 1/1993 | Okezie | |
| 5,232,118 | A | 8/1993 | Samuel | |
| 5,363,980 | A * | 11/1994 | Mulcahy | 220/495.07 |
| D353,696 | S | 12/1994 | Spencer | |
| D386,867 | S | 11/1997 | Clark | |
| 5,732,845 | A | 3/1998 | Armaly, Jr. | |
| D404,869 | S | 1/1999 | Jarman | |
| 5,913,606 | A * | 6/1999 | Nicholson | 383/11 |
| 6,012,686 | A | 1/2000 | Julian | |
| 6,029,844 | A | 2/2000 | Brady | |
| 6,059,458 | A * | 5/2000 | Belias et al. | 383/75 |
| 6,297,420 | B1 * | 10/2001 | Heincke | 602/41 |
| 6,343,409 | B1 | 2/2002 | McAllister | |
| 6,458,454 | B1 | 10/2002 | Kreckel | |
| 6,537,408 | B1 * | 3/2003 | Rossiter | 156/212 |
| D489,154 | S * | 4/2004 | Tipp et al. | D34/10 |
| 2004/0089665 | A1 * | 5/2004 | Nnamani | 220/495.08 |

* cited by examiner

*Primary Examiner*—Anita King
*Assistant Examiner*—Amy J. Sterling

(57) ABSTRACT

A liner retainer device for attachment to a folded upper section of a liner of a waste container comprises an elongated flexible unitary body having a first side which is printable and a second side upon which is applied pressure sensitive adhesive with a paper release covering adhered thereto. The paper release covering is scored so as to be divided into three segments, one defining a first end portion, one defining a second end portion and one defining a mid-section portion. The liner retainer body is formed of a thin material having sufficient elasticity to be disposed over uneven surface and material without exceeding the elastic limit of the material and with sufficient tensile strength to resist breaking or tearing. The paper release covering can be selectively peeled and removed to expose the adhesive thereunder sufficient to be useful as and for an attachment and securing means for the retention of liners for waste containers and an aid for the closure of the liner thereafter for disposal of the used liner.

1 Claim, 5 Drawing Sheets

LINER RETAINER DEVICE

CROSS REFERENCE TO RELATED APPLICATIONS

This application is a continuation-in-part of design application Ser. No. 29/169,748, filed Oct. 28, 2002 now U.S. Pat. No. D, 489,154 entitled "Retention Device for Wastebasket and Container Liners." The disclosure of this application is hereby incorporated by reference in its entirety, including all the figures.

FIELD OF THE INVENTION

This invention relates to devices to be applied to liners for waste baskets, trash cans and other similar containers to lock, constrict and secure the plastic film liner from collapsing or slipping into the container when material is put into the cavity of the liner which is then selectively releaseable and applied to secure closure of the open end of the used liner for disposal. More particularly, this invention relates to such devices adapted to be applied or attached to the liner after a liner is placed or inserted in the container of the type found in homes, offices, hospitals, other medical facilities and any other venue where refuse and waste material is deposited in waste container means.

BRIEF DESCRIPTION OF THE PRIOR ART

Waste container liners are fabricated from plastic film, such as MYLAR® polyester film, which have a closed end and an open end in the form of a bag. The liner is placed within the containment interior of a rigid container means with the top open end of the liner section typically folded over the upper rim of the container.

It is a natural function of humans to generate refuse and waste. This waste is generally placed or inserted in relatively small waste containers ranging in size from less than one gallon to greater than 55 gallons in size and may be of general geometric shapes, including square, rectangular, oblong and round. Plastic film liners are in general use to keep the interior of the containers clean, unsoiled and sanitary as needed and desired in homes, hospitals, other medical facilities and offices, among other venues which use refuse or waste containers. The upper section of the liner is generally folded over the upper rim of the waste container such that it encircles the upper portion of the waste container. The liner, if not restrained or constricted has the tendency to collapse or slip back into the container as the container is being filled. The liner thus disposed becomes part of the refuse or waste or it presents an unhealthy and disgusting chore to dig it out of the waste container as well as the misplaced refuse or waste to be properly placed in the liner for ultimate disposal means. In a hospital or other medical facility venue, the propensity of such liners to collapse or slip presents a great health problem and danger. This defeats the purpose for the liner which is employed so that the container can be kept clean and not soiled, the waste or refuse can be easily removed by it's containment in the liner and thus disposal be accomplished in a safe sanitary means.

Disadvantages exist with this arrangement if the liner is not secured to avoid the folded upper section of the liner from collapsing or slipping back into the waste container when refuse or waste is deposited in the lined waste container. When this occurs, the liner becomes part of the refuse or waste, the waste container is soiled and the removal of the liner as intended with the refuse or waste contained therein is compromised.

Attempts to remedy this disadvantage has been attempted, among other means, by 1) matching the opening end of the liner to the size of the waste container so that the upper section of the liner is stretched tightly around the exterior circumference of the waste container. This has not proven to be practical as the liner oft times splits or tears and there are numerous sizes and configurations of waste containers so there is no size fits all, 2) inserting the folded over upper section of the liner into a slot of an accumulator and knotting the accumulator to stretch the folded over upper section of the liner around the top of the container as set forth in Julian U.S. Pat. No. 6,012,686, 3) a clip to secure the liner/bag against the waste container as set forth in U.S. Pat. No. 6,343,409, 4) rubber bands or cords, rigid and flexible straps, ties of various sorts, weights, strings or cords made a part of the liner/bag, and an adhesive strip means which is part of the liner as set forth in U.S. Pat. No. 6,029,844. Many persons employ hand tied knots of the liner upper section which is mostly ineffective.

The present invention is designed to and does alleviate the deficiencies associated with the employment of the present afore described various means.

SUMMARY OF THE INVENTION

A primary object of the liner retainer of the present invention is to provide a tightening and constricting means for the retention of the folded upper portion of a liner disposed on the exterior of the rigid waste container to prevent the folded upper section of the liner from collapsing or slipping back into the waste container as refuse or waste is deposited therein and that does not suffer from the above enumerated deficiencies. Another object is to provide such an elongated adhesive strip body that is fabricated from thin, flexible plastic or paper material with a paper release covering adhered to the second side where the adhesive is applied thereto. A further object is to provide such a single use retaining device that is inexpensive and can be easily applied to such liners, which can thereafter easily be detached to release the tension and constriction provided and which can thereafter be used to secure closure of the liner for safe and sanitary disposal.

These objects and advantages will become apparent from the following description of the invention.

In accordance with the present invention, there is provided a liner retainer incorporating a quick, inexpensive, disposable and reliable flexible elongated adhesive surface means pressurably attachable to the upper portion of the folded upper section for stretching and constricting the folded upper section of the liner tightly around the top of a waste container, thereby retaining and constricting the folded upper section of the liner in place so that the liner does not collapse or slip back into the waste container as it is being filled. After the waste container/liner is used to the extent that the refuse or waste is to be disposed of, the adhesive surface retaining means of the present invention is easily detached from the surface of the liner, or the non-attached mid-section thereof can be torn away, thereby releasing the constricting tension to the folded upper section of the liner so that the liner with refuse or waste deposited therein can be safely and easily removed in the liner from the waste container. The paper release covering mid-section portion of the liner retainer body is then removed or peeled to be used to secure the closure of the top of the liner, safely encapsulating the refuse or waste therein for easy and sanitary disposal.

In the preferred embodiment, the retaining means is a liner retainer incorporating an elongated flexible adhesive strip body of an appropriate thickness, length and pertinent width to the circumference of the proposed waste container, composition and weight of the proposed liner, which comprises a first end portion of the body, a second end portion of the body, a mid-section portion of the body between the first end portion and the second end portion, a first side (top), a second side (bottom) and peripheral edges.

The liner retainer body material is comprised of paper or plastic film of varying thickness and width as may be required for the necessary adhesion area, tensile strength and tearability desired. The pressure sensitive adhesive is applied fully on the whole length of the second side which preferably has a zoned or sectioned paper release covering adhered thereto, and is exposed by the selective removal of the paper release covering from the first end portion, the second end portion or the mid-section portion as needed.

The paper release covering adhered to the second side of the liner retainer body constructed in accordance with the present invention comprises a zoned or sectioned paper release covering by a scoring which is cut only through the paper release covering to the second side of the liner retainer body material. The paper release covering is scored in no less than two venues, the same being inward from each terminus end a selected distance depending upon the area and strength of attachment desired. For example, in a particularly preferred embodiment, the paper release covering of a liner retainer body to secure a liner for a waste container such as is typically used in offices being eight (8) gallons in size or less is scored inward from each terminus end about one (1) inch which will define the first end portion and the second end portion of the liner retainer body and is sufficient to keep the liner retainer firmly attached upon the folded upper section of the liner to retain the tension and constriction needed.

The liner retainer body constructed in accordance with the present invention of the foregoing preferred embodiment stated is applied to the folded upper section of the liner by removing or peeling the paper release from the first end portion and second end portion of the liner retainer body to expose the adhesive. The paper release is not removed or peeled from the mid-section portion. The adhesive exposed first end portion is pressurably attached and adhered to a selected part of the folded upper section of the liner parallel to the upper edge or rim of the waste container. A portion of the folded upper liner section is gathered so that the non-gathered portion of the upper section of the liner is stretched, tightened and securely constricted around the whole circumference of the waste container and the gathered material is disposed under the unexposed or non-adhesive mid-section portion of the adhesive strip. The adhesive exposed second end portion of the liner retainer body is then pressurably attached to the folded upper section of the liner past the gathered portion retaining a generally parallel position of the adhesive strip to the upper edge or rim of the waste container. The gathered portion of the folded upper section of the liner thus placed is not restricted by adhesive but is constricted by the pressure of the mid-section of the strip resulting from the stretching of the liner retainer body across the gathered material.

When the liner is to be taken out of the waste container, the first end portion of the liner retainer body and second end portion of the liner retainer body can be removed of their respective attachments and adherence to the liner material by lifting or pulling the first end portion of the liner retainer and second end portion of the liner retainer body therefrom or the body of the liner retainer can be selectively cut or torn at either end of the mid-section portion, either of which will release the tension and constriction of the folded upper liner section from the waste container for easy unrestricted removal of the liner from the waste container. After the mid-section portion of the liner retainer body is cut or torn so as to be detached from the first end portion and the second end portion, the paper release covering the second side of the liner retainer body mid-section portion is removed to expose the pressure sensitive adhesive on the second side of the liner retainer body mid-section portion. After removal of the liner and the upper open end section of the liner reduced to closure conformation, the exposed adhesive of the liner retainer body mid-section portion can be used to wrap or crimp around the gathered material to secure the closure.

Individual liner retainer bodies may be provided in by a plurality of liner retainer bodies joined together in a continuous strip or in a sheeted format.

Another preferred embodiment may be provided by a plurality of liner retainers in a roll consisting of a long continuous elongated strip segmented into a plurality of individual predetermined liner retainer bodies incorporating zoned adhesive. The adhesive is disposed upon the second side of the body of the liner retainer bodies in alternating adhesive-nonadhesive sections, each section of adhesive and the section of nonadhesive having a predetermined length.

The body of the liner retainer may not have a paper release covering adhered to the second side. The first side face of the liner retainer body is provided with or consists of a non-adhering plastic, plasticized or other surface to which the pressure sensitive adhesive will not attach or adhere. The individual liner retainer body is removed from the roll to the extent that the predetermined length of the liner retainer body is obtained which is comprised of an exposed adhesive disposition on the first end portion and on the second end portion with no adhesive on the mid-section portion. The individual liner retainer body is cut or torn from the continuous roll at the terminus of the second end portion, thus detaching the elongated strip from the remaining rolled material. The liner retainer body is then attached to the folded upper section of the liner in the same manner and form as above described. The tension and constriction is released either by detachment of the first end portion and the second end portion of the liner retainer body or by cutting or tearing the liner retainer body in the mid-section portion as may be desired.

BRIEF DESCRIPTION OF THE DRAWINGS

These, as well as other features of the present invention will become more apparent upon reference of the drawings wherein.

DESCRIPTION OF THE PREFERRED EMBODIMENT

Figure 1:
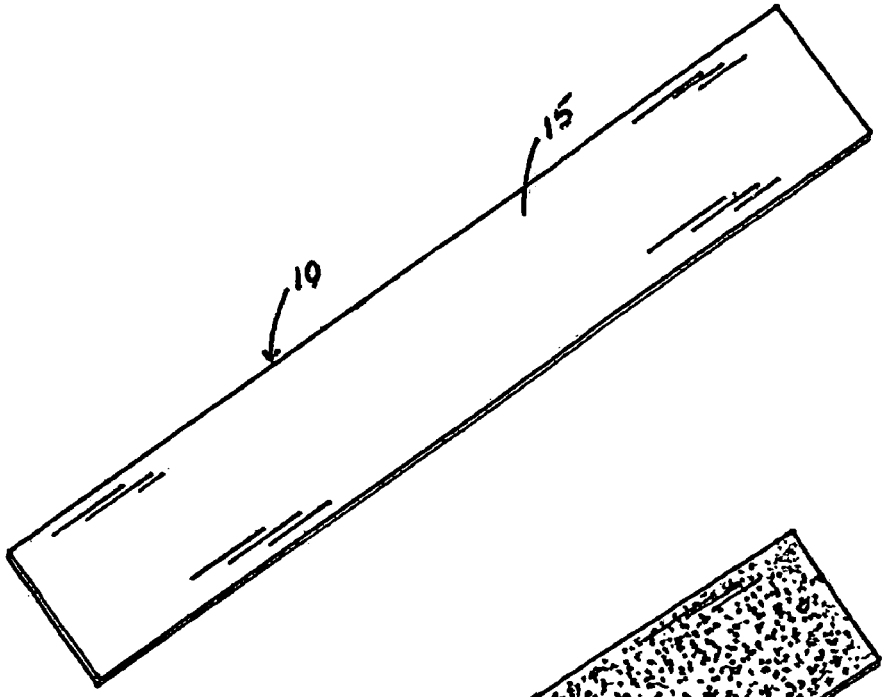
FIG. 1 is a perspective view of the top or first side of the liner retainer body in accordance with the present invention.
Figure 2:
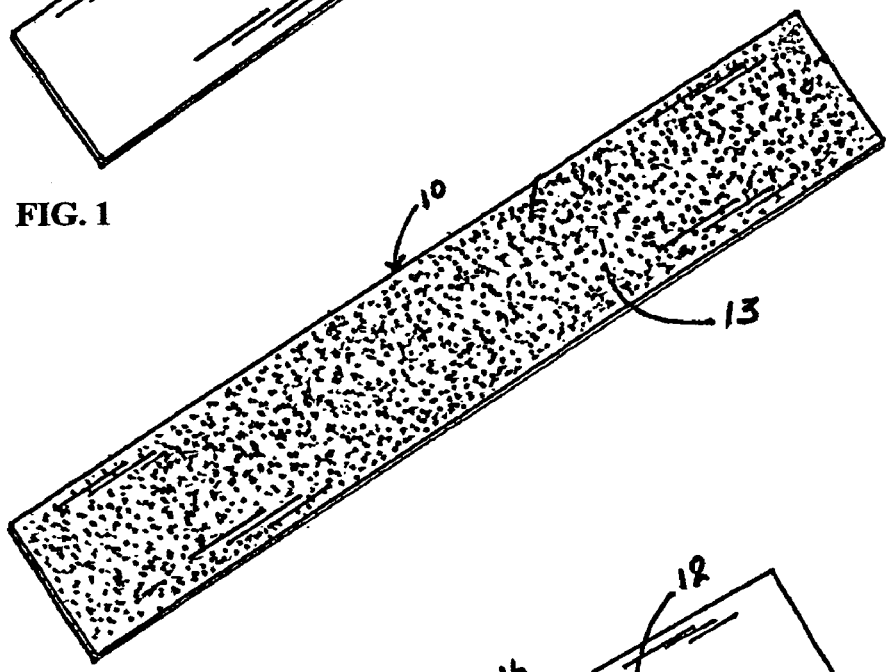
FIG. 2 is a perspective view of the bottom or second side of the liner retainer body with the pressure adhesive applied thereto.
Figure 3:
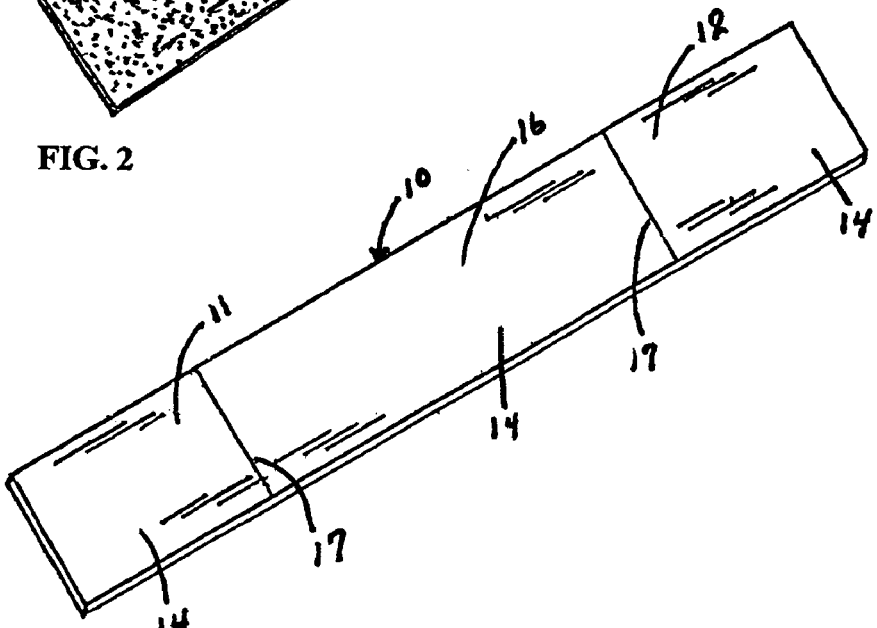
FIG. 3 is a perspective view of the bottom or second side of the liner retainer body with paper release covering adhered thereto with lateral scoring defining the first end portion of the liner retainer body, second end portion of the liner retainer body and mid-section portion of the liner retainer body.
Figure 4:
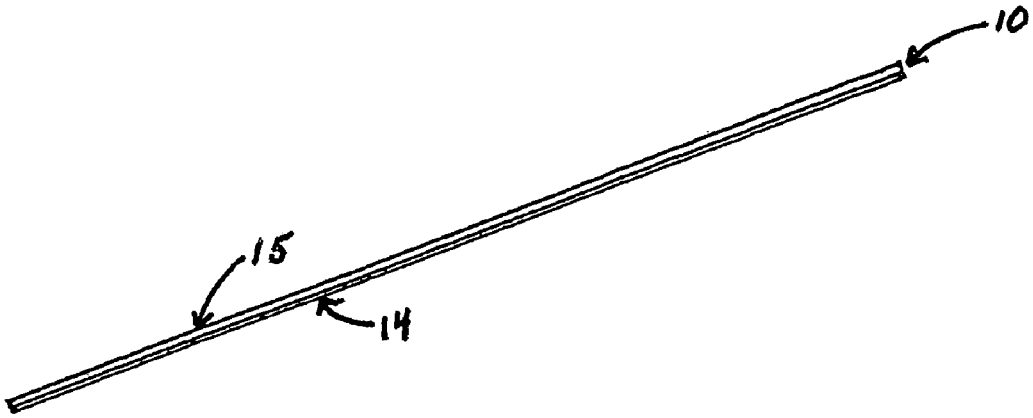
FIG. 4 is a side elevational view illustrating the second edge of the liner retainer body showing the laminate of the paper release covering to the second side of the liner retainer, the first edge is a mirror thereof.

Referring now to the drawings wherein the showings are for purposes of illustrating embodiment of the present invention only, and not for the purposes of limiting the same, FIG. 1, 3 illustrates the first side 15 of the liner retainer body 10 constructed in accordance with the present invention. The liner retainer body 10 is formed of a plastics or paper material that is sufficiently elastic that the liner retainer body 10 can conform to the bulk of the gathered material and surface variations of a waste container 22. The second side of the liner retainer 19 has applied to it pressure sensitive adhesive 13, FIG. 2, which has a paper release covering 14 adhered to it. FIGS. 4,5,6,9 and 10. The paper release covering 14 is scored 17 selectively illustrating that the first end portion 11 of the liner retainer body 10 comprises a designated portion 11 of the liner retainer body 10, the second end portion 12 of the liner retainer body 10 comprises a comparable designated portion 12 of the liner retainer body 10 and a mid-section portion 16 of the liner retainer body 10 lying between the first end portion 11 and the second end portion 12.

Figure 5:
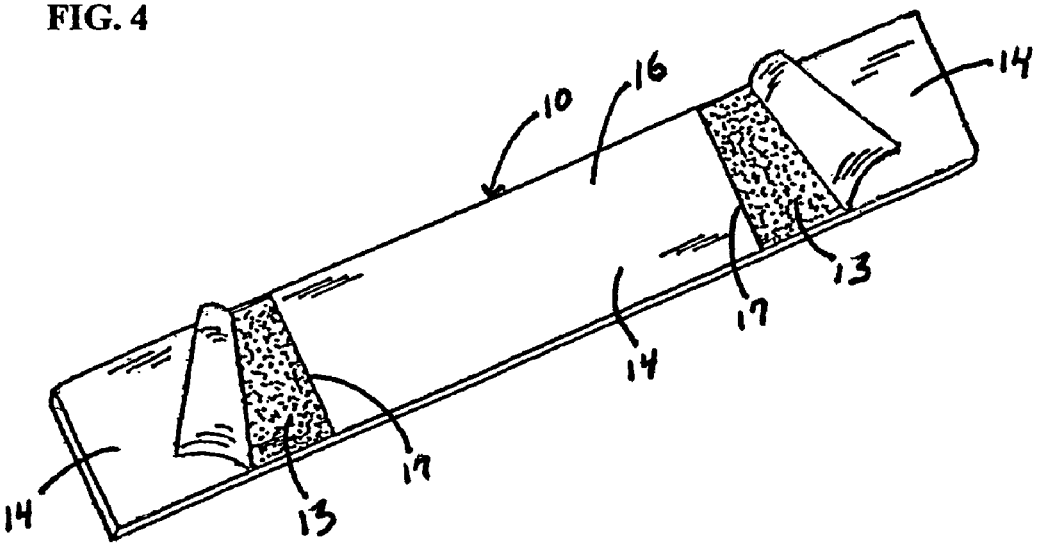
FIG. 5 is a perspective view of the liner retainer body illustrating the manner in which the paper release covering is removed from the first end portion of the liner retainer and from the second end portion of the liner retainer body.
Figure 6:
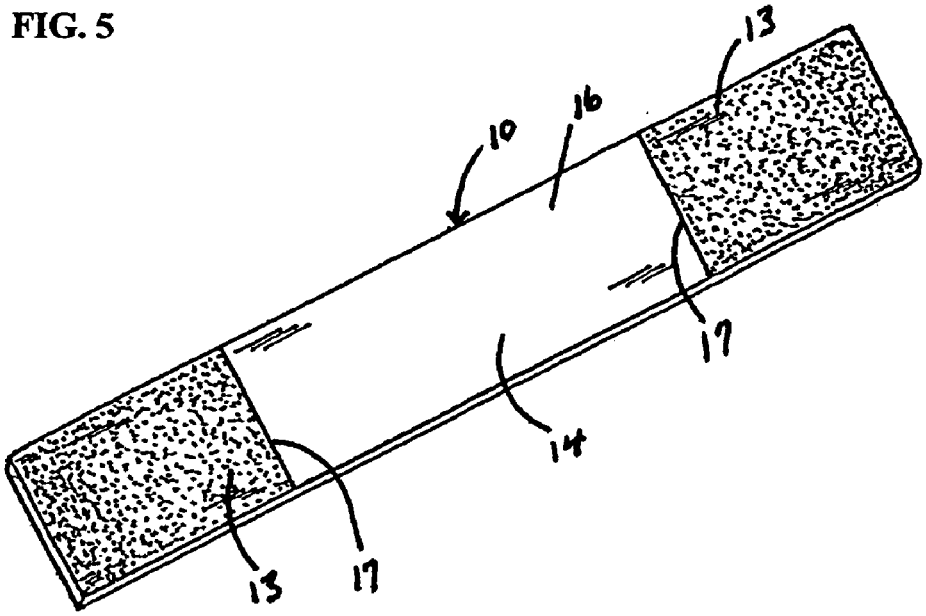
FIG. 6 is a perspective view of the second side of the liner retainer body with paper release covering removed from the first end portion of the liner retainer body and from the second end portion of the liner retainer body.
Figure 7:
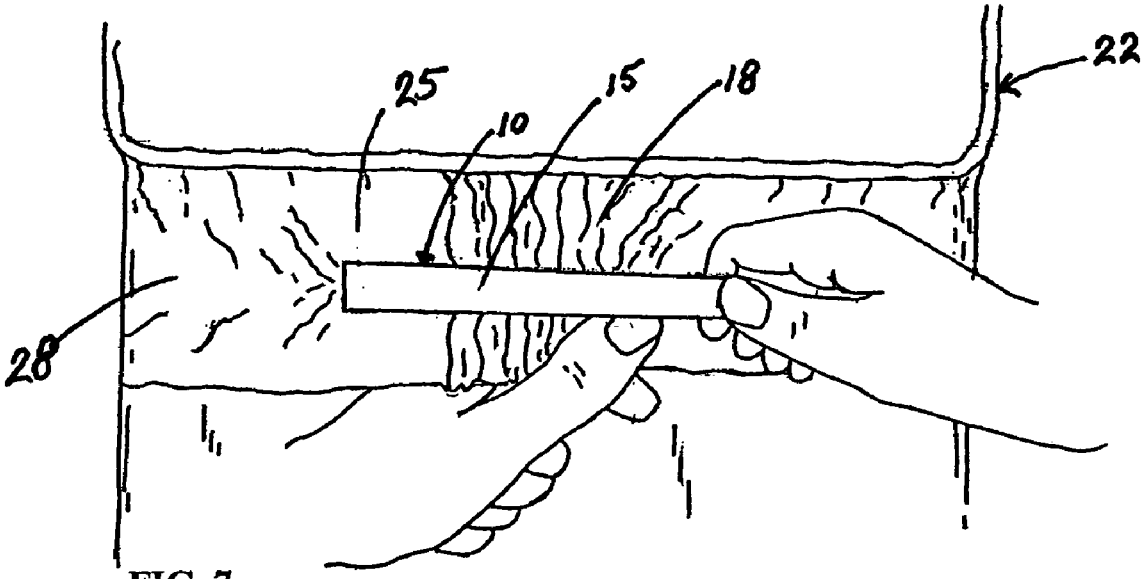
FIG. 7 is a perspective view illustrating the manner in which the liner retainer body is attached or adhered to the folded upper section of the liner extending below the upper edge or rim of the waste container.
Figure 8:
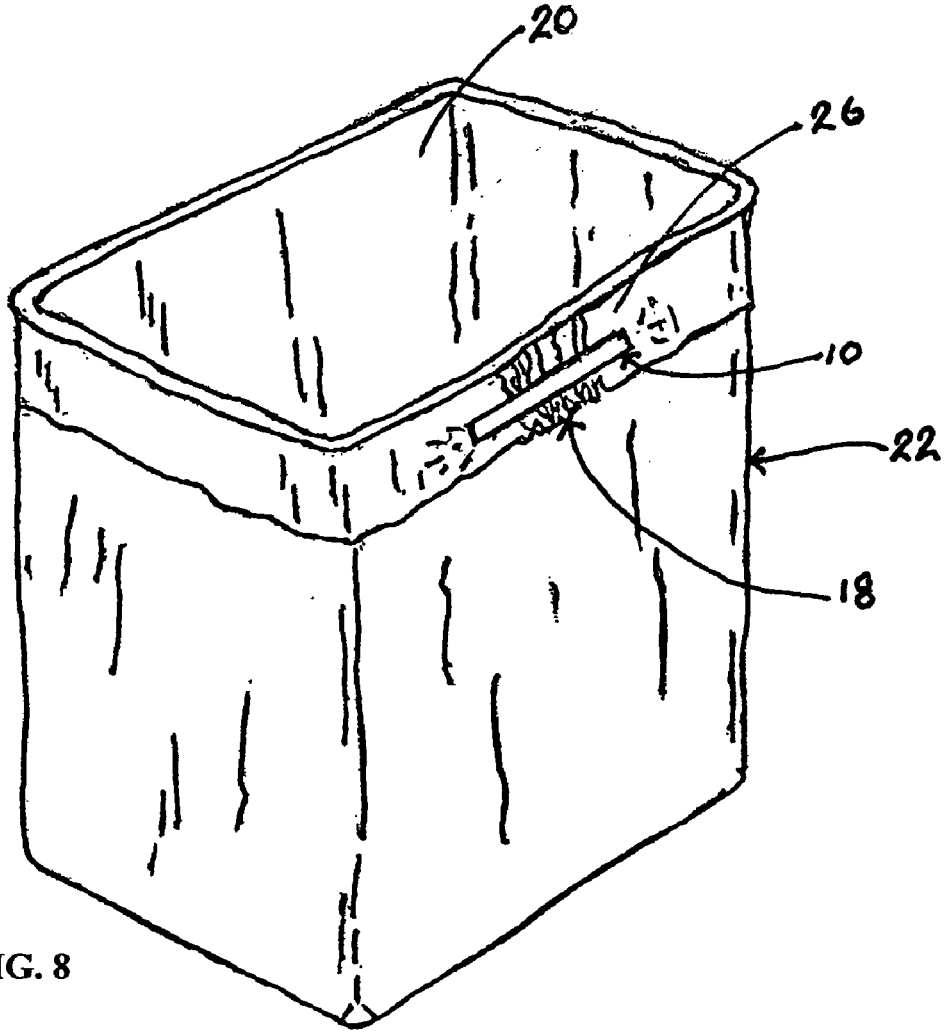
FIG. 8 is a perspective view illustrating the folded upper section of the liner as secured to the waste container with the liner retainer in accordance with the present invention.

When the liner retainer body 10 is to be applied to the folded upper section of the liner 28 of a waste container 22 so that the liner 20 can be retained and constricted from collapsing or slipping into the interior of the waste container 22, FIG. 7 the paper release covering 14 on the first end portion 11 of the liner retainer 10 and the paper release covering 14 on the second end portion 12 of the liner retainer body 10 is peeled off thereby exposing the pressure sensitive adhesive 13 on those portions 11, 12 of the liner retainer 10. FIGS. 5 and 6. The exposed adhesive 13 of the first end portion 11 of the liner retainer body 10 is pressurably attached to a selected area 25 of the folded upper section of the liner 20. The liner retainer body 10 is gripped on the second end portion 12 and pulled forward along its longitudinal axis whilst the material 18 under the liner retainer body 10 is gathered so as to pull the folded upper section of the liner 28 tightly around the circumference of the waste container 22. FIG. 6. Upon obtaining the desired tightness of the liner 20 as aforesaid, the second end portion 12 of the liner retainer body 10 is pressurably attached or fixed to a selected area 26 of the folded upper section of the liner 28 to retain the tightness and constriction of the liner 20 around the circumference of the waste container 22. FIG. 7.

Figure 11:
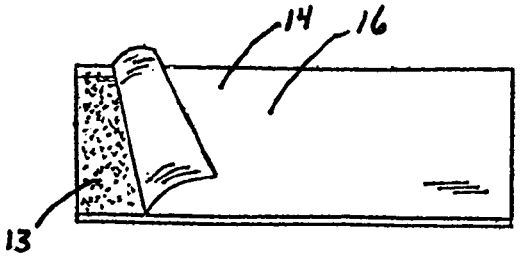
FIG. 11 is a perspective view illustrating peeling of the paper release covering from the second side of the mid-section portion of the liner retainer body after it's separation from the first end portion and the second end portion of the liner retainer body.
Figure 13:
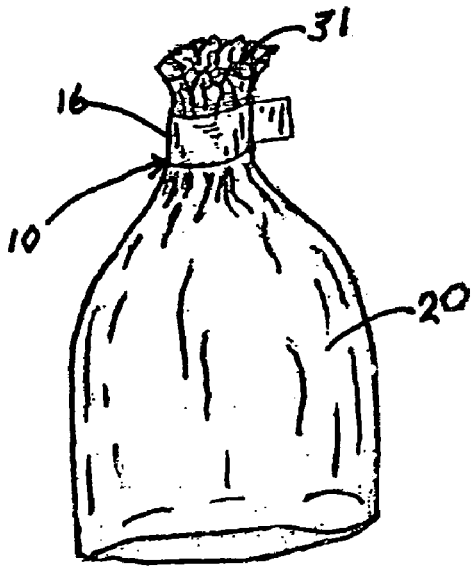
FIG. 13 is a side elevational view illustrating the crimp of the exposed adhesive second side mid-section portion of the liner retainer body securing closure of the closed liner top.
Figure 12:
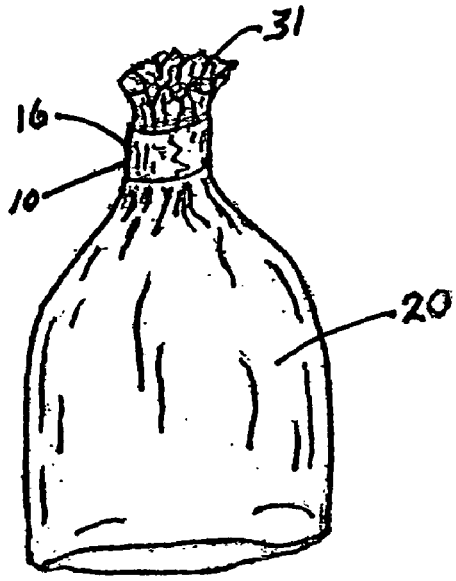
FIG. 12 is a side elevational view illustrating the wrap of the exposed adhesive second side of the mid-section portion of the liner retainer body securing closure of the closed liner top.

To remove the liner from the interior of the waste container 22 the folded upper section of the liner 20 can be detached by pulling the liner retainer body 10 outward which will cause the first end portion 11 of the liner retainer 10 and the second end portion 12 of the liner retainer body 10 to disengage from their respective attachments 25, 26 or the mid-section portion 16 of the liner retainer body 10 can be torn or cut laterally which will fully release the tension and constriction of the liner 20 around the circumference of the waste container. Upon such release, the liner retainer body 10 will not restrict the easy removal of the liner 20 from the interior of the waste container 22. When the mid-section portion 16 of the liner retainer body 10 is torn or cut so that sufficient portion of the liner retainer body 10 is available, the paper release covering 14 adhered to the mid-section portion 16 is peeled off thereby providing an adhesive strip which can be wrapped (FIG. 11) or crimped (FIG. 12) around the gathered top 31 of the removed liner 20 to secure it's closure for disposal. FIGS. 11, 12, 13.

Figure 10:
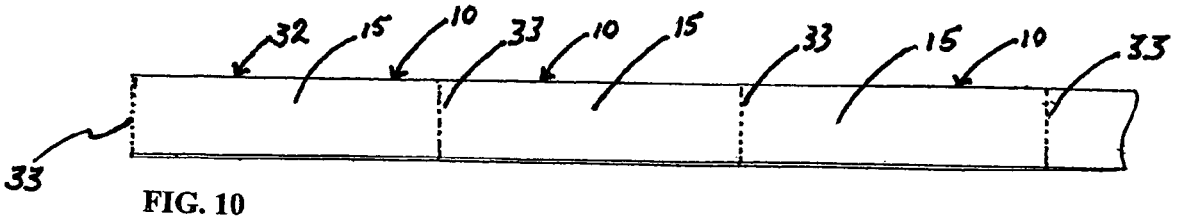
FIG. 10 is a top plan view illustrating the first side of the liner retainer body tear-off separation point perforation provided for detachment of an individual liner retainer body off from the continuous strip.

Individual liner retainer bodies 10 can be joined in a continuous strip 32 separated by a perforation 33 whereby the individual liner retainer body 10 can be torn or cut for easy detachment. FIG. 10.

Figure 9:
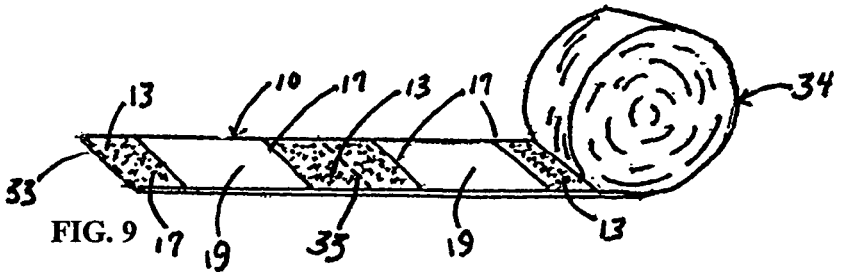
FIG. 9 is a perspective view illustrating the applied zoned adhesive on the second side of a continuous strip of a plurality of individual liner retainer bodies made and provided in a roll.

Individual liner retainer bodies 10 may be joined in a continues strip comprising a plurality of joined individual liner retainer bodies 10 in a roll form 34, paper release covering 14 is optional. FIG. 9. The second side 16 of the individual liner retainer bodies have zoned or sectioned pressure sensitive adhesive 13 applied alternately which will comprise the first end portion 11 of the liner retainer body 10 and the second end portion 12 of the liner retainer body 10 with non-adhesive mid-section portion 16. The adhesive 13 on the second side portion 12 of the liner retainer bodies 10 interface to the first side 15 of the liner retainer bodies 10 which is comprised of a material to which the adhesive will not adhere. When an individual liner retainer body 10 is desired, the individual liner retainer body 10 is detached by tearing or cutting it off at the perforation 33 provided. The individual liner retainer body 10 thus obtained is selectively attached to the folded upper section of the liner 28 in the same manner and method as before described.

Figure 14:
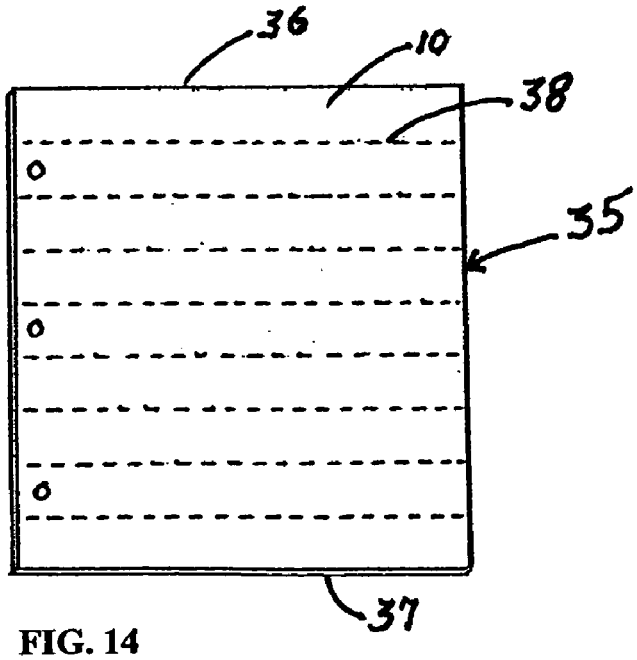
FIG. 14 is a perspective view illustrating the first side of a plurality of liner retainer bodies produced in a sheeted format.

To provide liner retainer bodies 10 in a sheet format 35, the individual liner retainer bodies 10 are joined together from the top of the sheet 36 to the bottom of the sheet 37 in equal widths separated by perforations 38 which provide easy detachment for each individual liner retainer body 10. FIG. 14.

The first side 15 of the liner retainer body 10 provides sufficient space for the printing of advertising messages and slogans. Consequently, the first side 15 of the liner retainer body 10 can serve as an advertising medium in addition to serving as a convenience and a retainer.

While the preferred embodiment of the invention has been described herein, variations in the design may be made. For example, the liner retainer body could be designed to accommodate special logos, caricatures, special advertising format and forms. The scope of the invention, therefore, is only to be limited by the claims appended hereto.

The embodiments of the invention in which an exclusive property is claimed are defined as follows:

What is claimed is:

1. A method of applying a liner retainer device to a folded upper section of a liner in a waste container, the liner retainer device comprising an elongated flexible body, a first side of the body, a second side of the body, a first end of the body, a first end portion of the body, a second end of the body, a second end portion of the body, a mid-section portion of the body located between the first end portion of the body and the second end portion of the body, a pressure sensitive adhesive adhered to the whole of the second side of the body and a paper release covering adhered to the adhesive; the paper release covering being scored at a juncture of the first end portion of the body and the adjacent mid-section portion of the body and scored at a juncture of the second end portion of the body and the adjacent mid-section portion of the body so as to separate the paper release covering into three sections and define the first end portion of the body, the mid-section portion of the body and the second end portion of the body, the paper release covering being selectively removable to expose the adhesive adhered to the second side of the body; the method comprising the steps of:

removing the paper release covering from the first end portion of the body revealing the adhesive on the first end portion;

adhering the first end portion to the folded upper section of the liner;

gathering the liner taut around the waste container; and removing the paper release of the second end portion revealing the adhesive on the second end portion;

adhering the second end portion of the body from which the paper covering has been to the liner to secure the upper section of the liner about the waste container;

leaving the paper covering of a mid-section portion intact covering the adhesive;

separating the mid-section portion of the liner retainer device from the first end portion and the second end portion;

gathering the upper section of the liner; and removing the paper covering form the mid-section to reveal the adhesive on the mid-portion;

adhering the mid-section portion from which the paper covering has been removed to reveal the adhesive around the gathered upper section of the liner.

* * * * *